US005394966A

United States Patent [19]

Chow

[11] Patent Number: 5,394,966

[45] Date of Patent: Mar. 7, 1995

[54] LATCH DEVICE FOR A CASE

[76] Inventor: Jessie Chow, No. 18, Hou Juan Road, Taichung, Taiwan, Prov. of China

[21] Appl. No.: 246,995

[22] Filed: May 20, 1994

[51] Int. Cl.[6] ..... A45C 13/10

[52] U.S. Cl. ..... 190/119; 220/324; 292/204; 292/246

[58] Field of Search ..... 220/324, 4.22; 292/246, 292/54, 204, 202, DIG. 38; 190/121, 115, 119; 206/1.5

[56] References Cited

U.S. PATENT DOCUMENTS

| | | | |
|---|---|---|---|
| 3,000,535 | 3/1959 | Erdmann | 292/285 X |
| 3,876,247 | 4/1975 | Chilewich | 190/115 X |
| 3,994,519 | 11/1976 | Williams | 292/246 |
| 4,011,940 | 3/1977 | Neal et al. | 206/1.5 |
| 4,117,914 | 10/1978 | Snyder | 190/115 |
| 4,576,307 | 3/1986 | Frydenberg | 190/119 X |
| 4,643,281 | 2/1987 | Erickson | 190/119 |
| 4,974,740 | 12/1990 | Niles et al. | 220/324 |
| 5,035,344 | 7/1991 | Christopher | 220/324 X |
| 5,123,681 | 6/1992 | Kos et al. | 292/DIG. 38 |

*Primary Examiner*—Allan N. Shoap
*Assistant Examiner*—Christopher McDonald
*Attorney, Agent, or Firm*—Charles E. Baxley

[57] ABSTRACT

A latch device may secure a cover to a base of a case. A groove and a boss are formed in the base, and another groove and another boss are formed in the cover and aligned with the groove and the boss of the base. aperture formed in the first groove. The latch device includes a cylinder rotatably engaged in the grooves, and a ring secured to the cylinder for engaging with the bosses and for securing the cover to the base. The cylinder can be stably supported in place and will not be easily damaged.

8 Claims, 4 Drawing Sheets

LATCH DEVICE FOR A CASE

BACKGROUND OF THE INVENTION

1. Field of the Invention

The present invention relates to a latch device, and more particularly to a latch device for a case.

2. Description of the Prior Art

A typical latch device for a case is shown in FIG. 5, in which the case comprises a base 90 having a protrusion 95 provided therein, and a cover 91 having a latch device 93 secured thereto, the latch device 93 includes a lip 94 for engaging with the protrusion 95 of the case 90 so as to secure the cover 91 with the base 90. However, the latch device 93 is solidly secured to the cover 91 and formed integral with the cover 91, and the latch device 93 and the cover 91 are formed by molding processes, such that the latch device 93 is apt to be broken and disengaged from the cover 91 after several folding operations of the latch device 93 relative to the cover 91.

The present invention has arisen to mitigate and/or obviate the afore-described disadvantages of the conventional latch devices for cases.

SUMMARY OF THE INVENTION

The primary objective of the present invention is to provide a latch device which can be solidly secure the cover and the base of a case together and which will not be easily disengaged from the case.

In accordance with one aspect of the invention, there is provided a latch device for a case. The case includes a base having a first groove and a first boss formed thereon, and a cover having a second groove and a second boss formed thereon and aligned with the first groove and the first boss of the base respectively, an aperture formed in the first groove. The latch device comprises a cylinder rotatably engaged in the grooves, and a ring secured to the cylinder for engaging with the bosses and for securing the cover to the base.

A catch means is provided for securing the cylinder to the base and for rotatably supporting the cylinder in the first groove. The catch means includes a pair of lips extended from the cylinder for engaging in the aperture and for securing the cylinder to the base. The ring includes a knob formed thereon for operating the ring.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
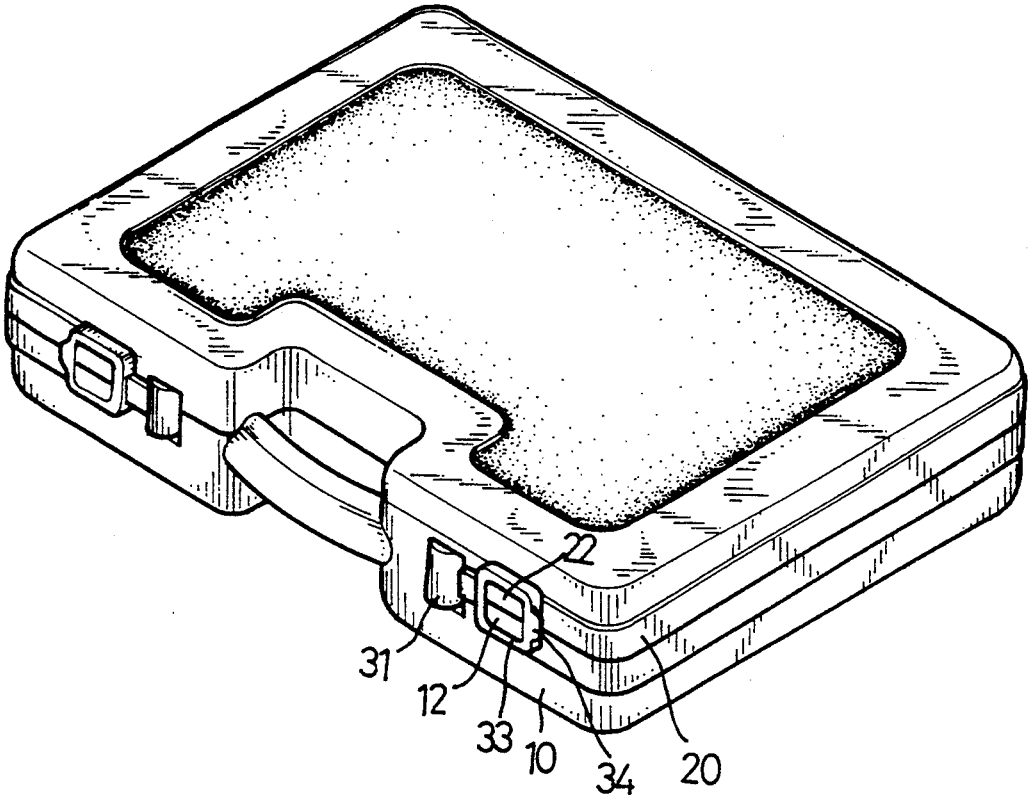
FIG. 1 is a perspective view of a case having a latch device in accordance with the present invention.
Figure 2:
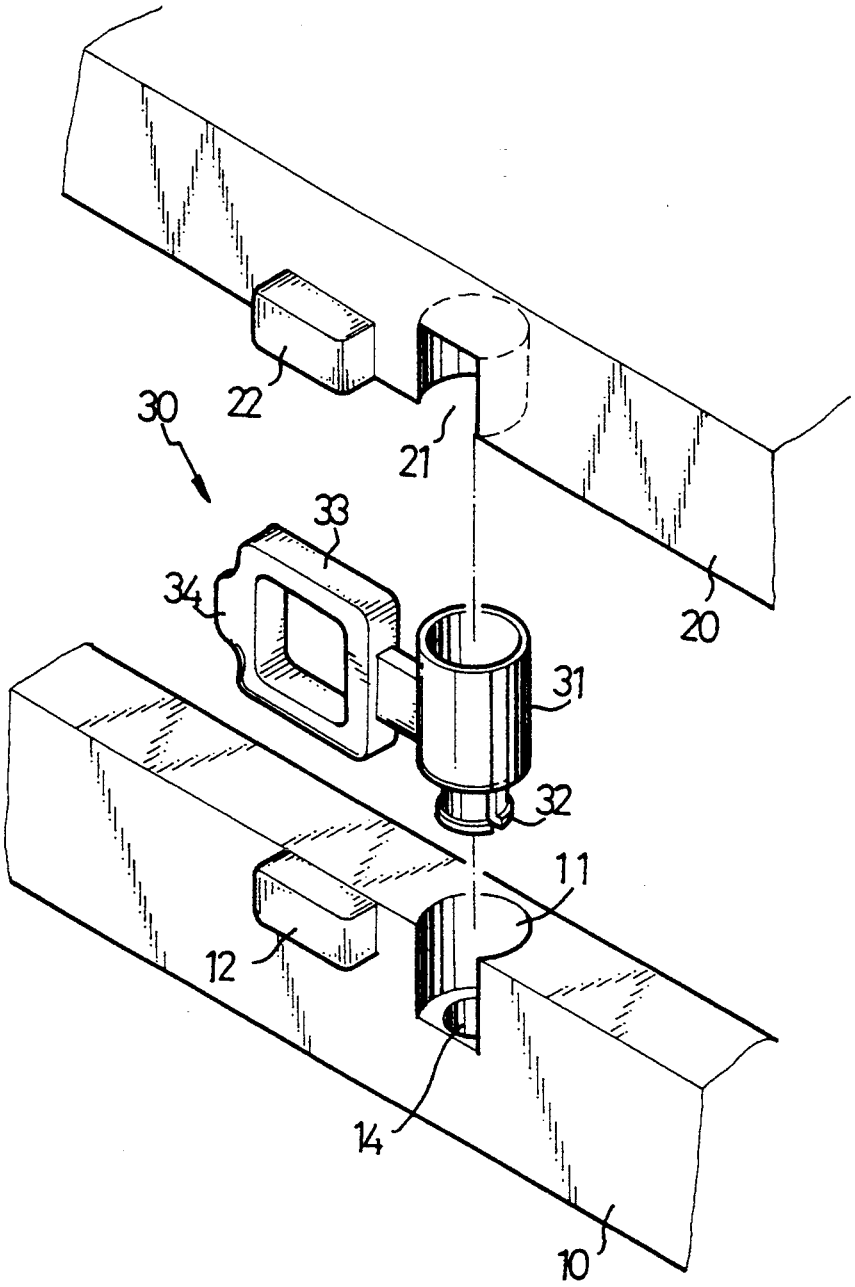
FIG. 2 is an exploded view of the latch device.
Figure 3:
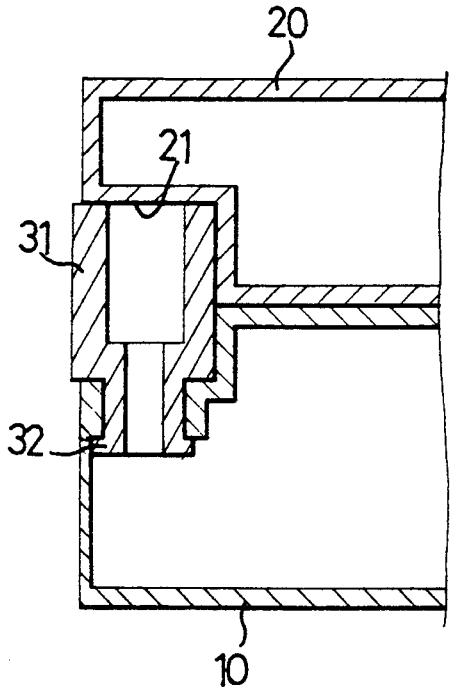
FIG. 3 is a cross sectional view taken along lines 3—3 of FIG. 4.
Figure 4:
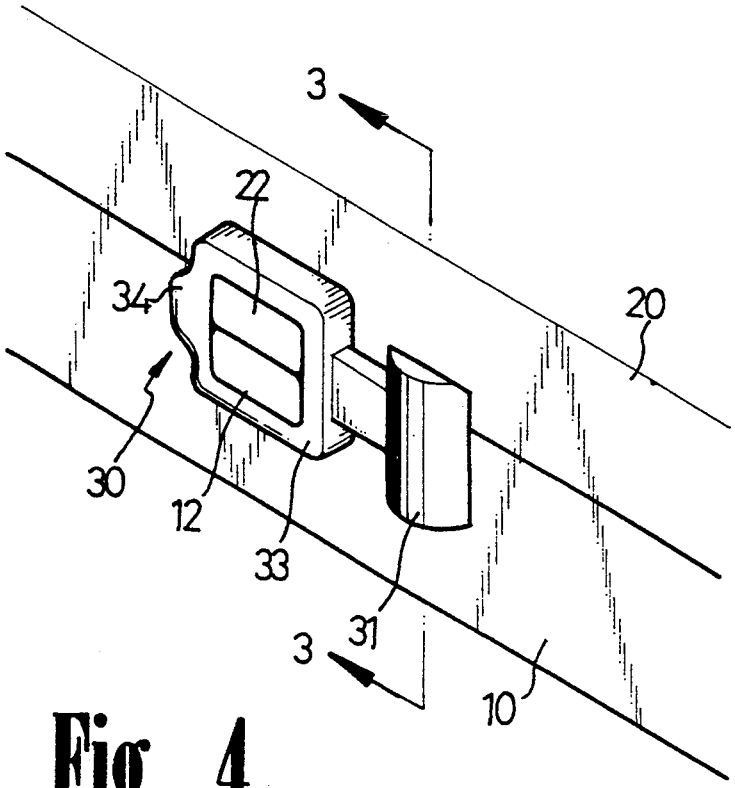
FIG. 4 is a perspective view showing the outer appearance of the latch device.
Figure 5:
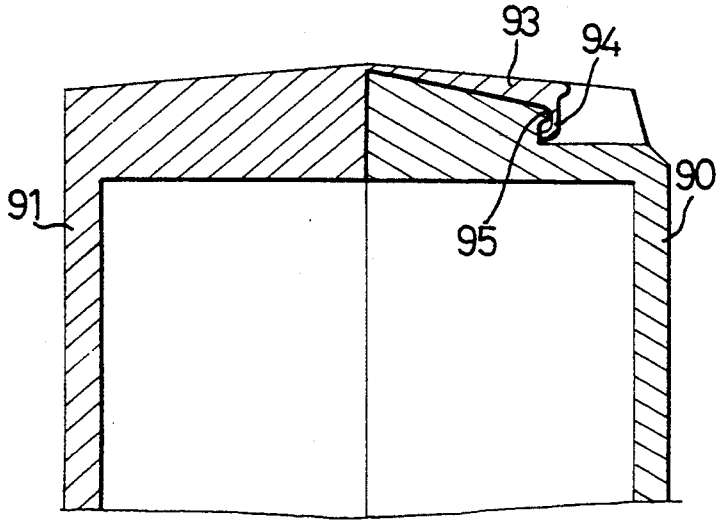
Fig 5 PRIOR ART
FIG. 5 is a cross sectional view illustrating the typical latch device for cases.

Referring to FIGS. 1 to 4, a latch device 30 in accordance with the present invention is provided for locking a cover 20 to a base 10 of a case. The base 10 includes a groove 11 and an aperture 14 formed therein and a boss 12 formed thereon. The aperture 14 is communicated with the groove 11. The cover 20 also includes a groove 21 and a boss 22 aligned with that of the base 10 respectively when the cover 20 is engage with the base 10.

The latch device 30 includes a cylinder 31 rotatably engagable in the grooves 11, 21 of the base 10 and the cover 20 respectively, and a ring 33 secured to the cylinder 31. The cylinder 31 includes a catch means having a pair of lips 32 for engaging with the aperture 14 of the base 10 such that the cylinder 31 can be rotatably coupled to the base 10, best shown in FIGS. 3 and 4, and such that the ring 33 may be rotated to engage with the bosses 12, 22. The ring 33 may further includes a knob 34 for operating the ring 33.

It is to be noted that the cylinder 31 can be stably supported in the grooves 11, 21 and is freely rotatable such that the latch device may be used for a long time.

Accordingly, the latch device in accordance with the present invention includes a cylinder that can be stably supported in place and will not be easily damaged.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A case comprising a base and a cover, said base including a first groove and a first boss formed thereon, said cover including a second groove and a second boss formed thereon and aligned with said first groove and said first boss of said base respectively, a latch device including a cylinder rotatably engaged in said grooves, and a ring secured to said cylinder for engaging with said bosses so as to secure said cover to said base.

2. A case according to claim 1 further comprising a catch means for securing said cylinder to said base and for rotatably supporting said cylinder in said first groove.

3. A case according to claim 2, wherein said base further includes an aperture formed in said first groove, said catch means includes a pair of lips extended from said cylinder and engaged in said aperture for securing said cylinder to said base.

4. A case according to claim 1, wherein said ring includes a knob formed thereon for operating said ring.

5. A latch device for a case, said case including a base having a first groove and a first boss formed thereon, and a cover having a second groove and a second boss formed thereon and aligned with said first groove and said first boss of said base respectively, an aperture formed in said first grooves, wherein said latch device comprises a cylinder rotatably engaged in said grooves, and a ring secured to said cylinder for engaging with said bosses and for securing said cover to said base.

6. A latch device according to claim 5 further comprising a catch means for securing said cylinder to said base and for rotatably supporting said cylinder in said first groove.

7. A latch device according to claim 6, wherein said catch means includes a pair of lips extended from said cylinder for engaging in said aperture and for securing said cylinder to said base.

8. A latch device according to claim 5, wherein said ring includes a knob formed thereon for operating said ring.

* * * * *